US009985392B2

(12) United States Patent
Li et al.

(10) Patent No.: US 9,985,392 B2
(45) Date of Patent: May 29, 2018

(54) ELECTRICAL CONNECTOR

(71) Applicant: Molex, LLC, Lisle, IL (US)

(72) Inventors: Yong-Chao Li, Shanghai (CN); Jun Yin, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/615,193

(22) Filed: Jun. 6, 2017

(65) Prior Publication Data

US 2017/0365955 A1 Dec. 21, 2017

(30) Foreign Application Priority Data

Jun. 17, 2016 (CN) ..... 2016 2 0597680 U

(51) Int. Cl.

| | |
|---|---|
| ***H01R 13/648*** | (2006.01) |
| ***H01R 13/6581*** | (2011.01) |
| ***H01R 13/6594*** | (2011.01) |
| ***H01R 13/52*** | (2006.01) |
| ***H01R 24/60*** | (2011.01) |
| *H01R 107/00* | (2006.01) |

(52) U.S. Cl.

CPC ..... *H01R 13/6581* (2013.01); *H01R 13/5202* (2013.01); *H01R 13/6594* (2013.01); *H01R 24/60* (2013.01); *H01R 2107/00* (2013.01)

(58) Field of Classification Search

CPC ..... H01R 13/6587; H01R 13/6594; H01R 3/6873; H01R 13/7073

USPC ..... 439/607.4, 607.36, 607.25, 607.27

See application file for complete search history.

(56) References Cited

U.S. PATENT DOCUMENTS

| | | | | |
|---|---|---|---|---|
| 8,282,417 | B2 * | 10/2012 | Xiao | H01R 13/648 439/607.36 |
| 8,460,034 | B2 * | 6/2013 | Song | H01R 13/6594 439/607.36 |
| 8,827,742 | B2 | 9/2014 | Wang | |
| 9,425,560 | B1 * | 8/2016 | Su | H01R 13/6591 |

(Continued)

FOREIGN PATENT DOCUMENTS

| | | | |
|---|---|---|---|
| CN | 201594648 | U | 9/2010 |
| CN | 203589324 | U | 5/2014 |
| TW | M379889 | U | 5/2010 |

*Primary Examiner* — Phuong Dinh

(74) *Attorney, Agent, or Firm* — James A. O'Malley

(57) ABSTRACT

An electrical connector has an insulating body which comprises a housing and a tongue; a plurality of conductive terminals, each conductive terminal has a mating portion and a soldering portion; a metal inner shell which surrounds to form a first frame, the first frame is fixed on the insulating body and surrounds a rear portion of the tongue to form a mating cavity; a metal outer shell which surrounds to form a second frame, the second frame encircles an outside of the first frame, a plurality of soldering legs extend out from two sides of the metal outer shell; and an insulating outer shell which is engaged with the metal outer shell integrally, a rear portion of the insulating outer shell is formed with a receiving cavity; the metal inner shell is correspondingly inserted in the receiving cavity, the insulating outer shell surrounds a front portion of the tongue and forms an insertion opening, the insertion opening is integrally communicated with the mating cavity along a front-rear direction. The present disclosure can increase the overall structure strength and facilitate the smooth insertion of another mating connector.

10 Claims, 5 Drawing Sheets

(56) References Cited

U.S. PATENT DOCUMENTS

| | | | | |
|---|---|---|---|---|
| 2012/0315779 | A1 | 12/2012 | Yudate et al. | |
| 2016/0149349 | A1* | 5/2016 | Kao | H01R 13/6586 439/607.05 |

* cited by examiner

ELECTRICAL CONNECTOR

RELATED APPLICATIONS

This application claims priority to Chinese Application No. 201620597680.4, filed Jun. 17, 2016, which is incorporated herein by reference in its entirety.

TECHNICAL FIELD

The present disclosure relates to an electrical connector, and more specifically relates to an electrical connector which facilitates to smoothly insert another mating connector therein.

BACKGROUND ART

Chinese Patent application CN201210008719.0 discloses an electrical connector which comprises a metal shell, an insulating body mounted in the metal shell, a plurality of terminals fixed in the insulating body and an insulating outer shell covering the metal shell from the outside. The metal shell comprises a top wall and a bottom wall which are opposite and parallel to each other and a left side wall and a right side wall which each are connected to the top and bottom walls, the insulating body comprises a base fixed in the metal shell and a tongue extending forwardly along the base, the terminal is provided with a contact portion exposed on a surface of the tongue of the insulating body and a soldering portion extending out from the insulation body. A bottom surface of the insulating outer shell is securely provided with a metal retainer which comprises a fixing piece embedded in the insulating outer shell and a soldering piece extending out from the insulating outer shell along the fixing piece, two side edges of the fixing piece extend upwardly to form two retaining pieces which are perpendicular to the fixing piece, the two retaining pieces are embedded in the insulating outer shell, and the fixing piece is provided with a plurality of fixing legs perpendicular to the fixing piece, the fixing legs protrude out from the insulating outer shell, the fixing legs are formed by tearing and bending.

Such a design is that an insertion opening is formed by the metal shell in the front of metal shell, due to the limitation of the existing metal punching process technology, the metal shell, especially bent locations of the metal shell, is difficult to precisely control in dimension, which will easily results in that the insertion is not smooth and cracking possibly occurs in reality while another mating plug is inserted into the electrical connector. In addition, the need that soldering legs extend from a rear portion of the metal shell to provide grounding also causes an unnecessary increase in solder pads of a circuit board. It is desirable to make further improvement.

SUMMARY

The technical problem to be resolved by the present disclosure is to provide an electrical connector, which can reduce electromagnetic leakage, increase the overall structure strength, and can facilitate smooth insertion of another mating connector, so as to overcome the deficiency in the above prior art.

In view of the above technical problem, the present disclosure provides an electrical connector which is used to correspondingly mate with another mating connector. The electrical connector comprises: an insulating body which comprises a housing and a tongue extending forwardly out from the housing; a plurality of conductive terminals, each conductive terminal has a mating portion exposed on the tongue and a soldering portion extending backwardly out from the housing; a metal inner shell which surrounds to form a first frame, the first frame is fixed on the insulating body and surrounds a rear portion of the tongue to form a mating cavity; a metal outer shell which surrounds to form a second frame, the second frame encircles an outside of the first frame, the metal outer shell is electrically connected with the metal inner shell together, a plurality of soldering legs extend out from two sides of the metal outer shell; and an insulating outer shell which is engaged with the metal outer shell integrally, a rear portion of the insulating outer shell is formed with a receiving cavity; wherein the metal inner shell is correspondingly inserted in the receiving cavity, the insulating outer shell surrounds a front portion of the tongue and forms an insertion opening, the insertion opening is integrally communicated with the mating cavity along a front-rear direction.

In some embodiments, the metal inner shell further comprises two first wing plates extending out from a rear end of the first frame; the metal outer shell further comprises two second wing plates respectively extending out from the second frame, the two second wing plates correspondingly stack above the two first wing plates and are correspondingly electrically connected.

In some embodiments, the housing of the insulating body protrudes backwardly to provide a support portion, the two first wing plates are correspondingly supported on the support portion.

In some embodiments, the soldering portions of the conductive terminals extend backwardly out from the support portion; the electrical connector further comprises a seal formed by a sealing glue applied on a rear portion of the receiving cavity of the insulating outer shell, the support portion passes backwardly through the seal.

In some embodiments, two sides of the second frame are respectively torn and bent to respectively form two soldering legs, two outer sides of the two second wing plates are also respectively bent to form two soldering legs.

In some embodiments, the first wing plate and the second wing plate are securely connected together by laser spot welding.

In some embodiments, a plurality of abutting convex portion protrude from the first frame toward the inside of the mating cavity, and are used to engage with the another mating connector.

In some embodiments, an internal contour of the insertion opening is equal to or slightly smaller than an internal contour of the mating cavity, and the another mating connector passes through the insertion opening and inserts into the mating cavity.

In some embodiments, the insulating outer shell is engaged with the metal outer shell integrally by insert molding process; and wherein the second frame is penetratingly provided with a plurality of fixing holes, the insulating outer shell are correspondingly formed with a plurality of fixing columns which protrude into the fixing holes respectively.

In some embodiments, an outer periphery of a front portion of the insulating outer shell is sheathed with a waterproof sealing ring.

Compared with the prior art, by that the second frame of the metal outer shell sheathes on and electrically connects with the first frame of the metal inner shell, and the complete mating cavity is surrounded and formed by the first frame, and the electrical connector is electrically grounded via the soldering legs of the metal outer shell, the present disclosure can reduce electromagnetic leakage and increase the overall structure strength of the electrical connector; in addition, by engaging the insulating outer shell with the metal outer shell integrally and forming an insertion opening communicated with the mating cavity along the front-rear direction at the front portion of the insulating outer shell, it facilitate the smooth insertion of another mating connector.

DETAILED DESCRIPTION OF THE PREFERRED EMBODIMENTS

Figure 1:
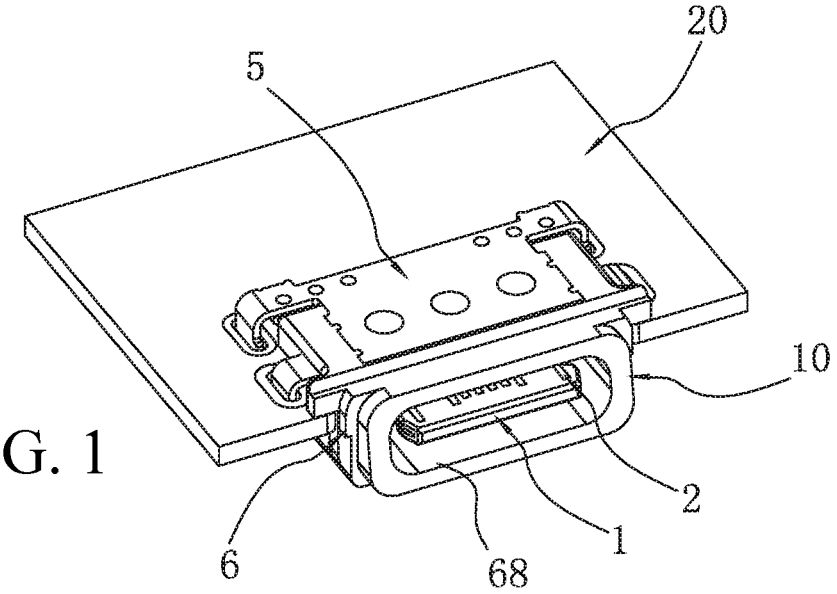
FIG. 1 is a perspective view of an electrical connector of a preferred embodiment of the present disclosure and a circuit board.
Figure 2:
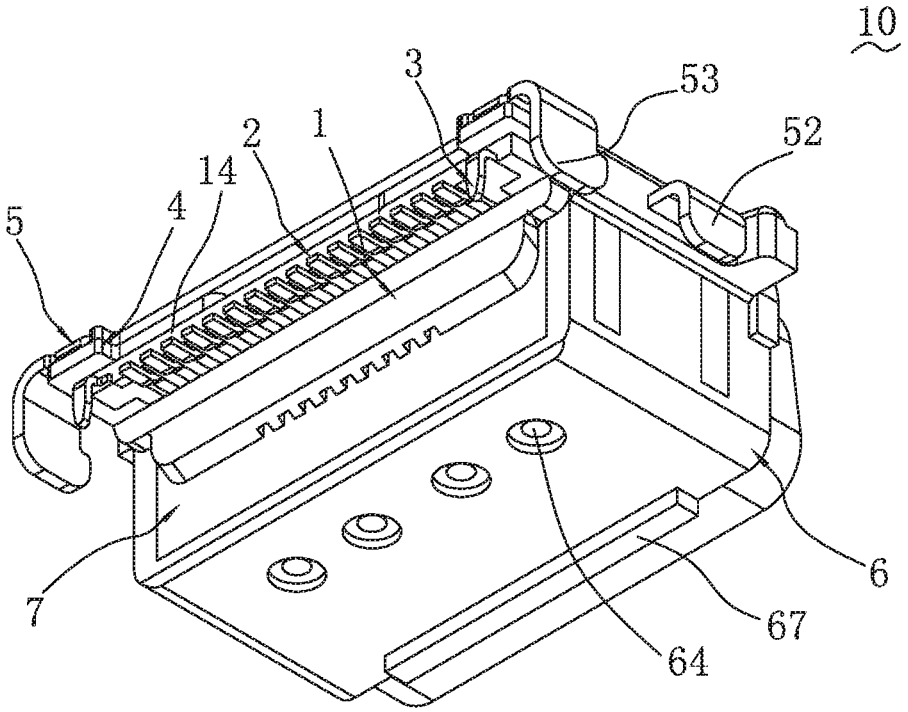
FIG. 2 is a perspective view of the electrical connector of the preferred embodiment of the present disclosure.
Figure 3:
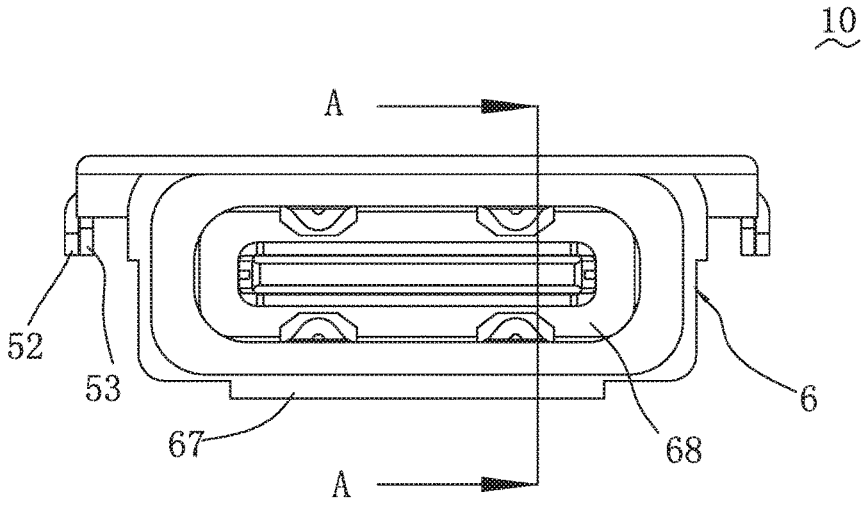
FIG. 3 is a front view of the electrical connector of the preferred embodiment of the present disclosure.
Figure 4:
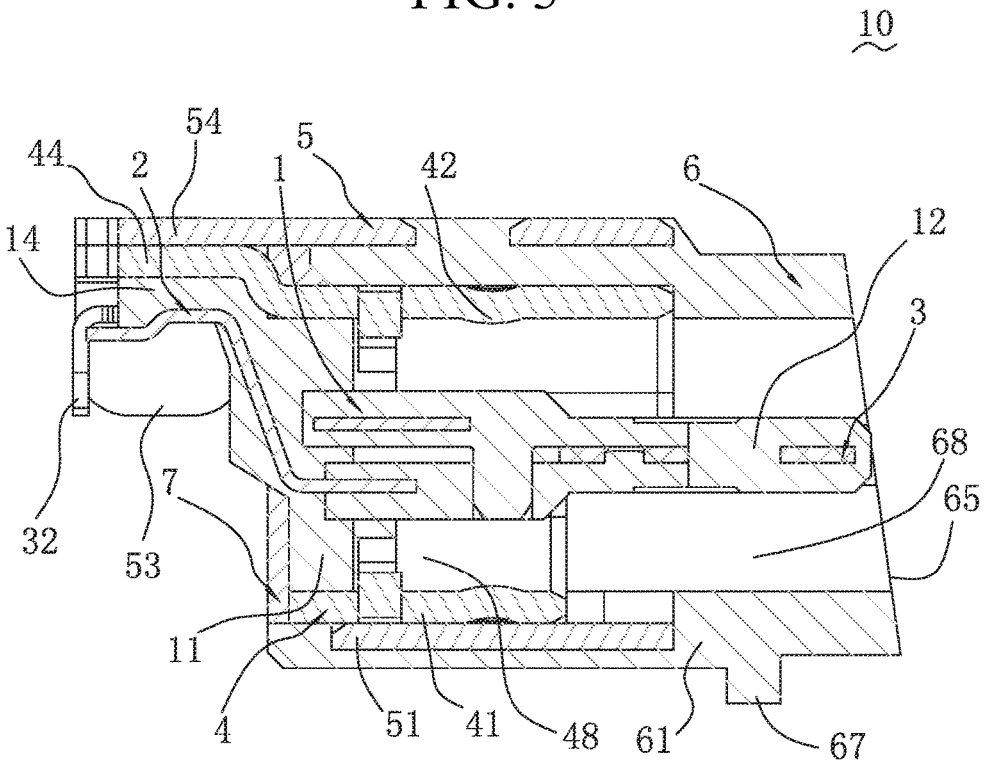
FIG. 4 is a cross-sectional view taken along a line A-A of FIG. 3.
Figure 5:
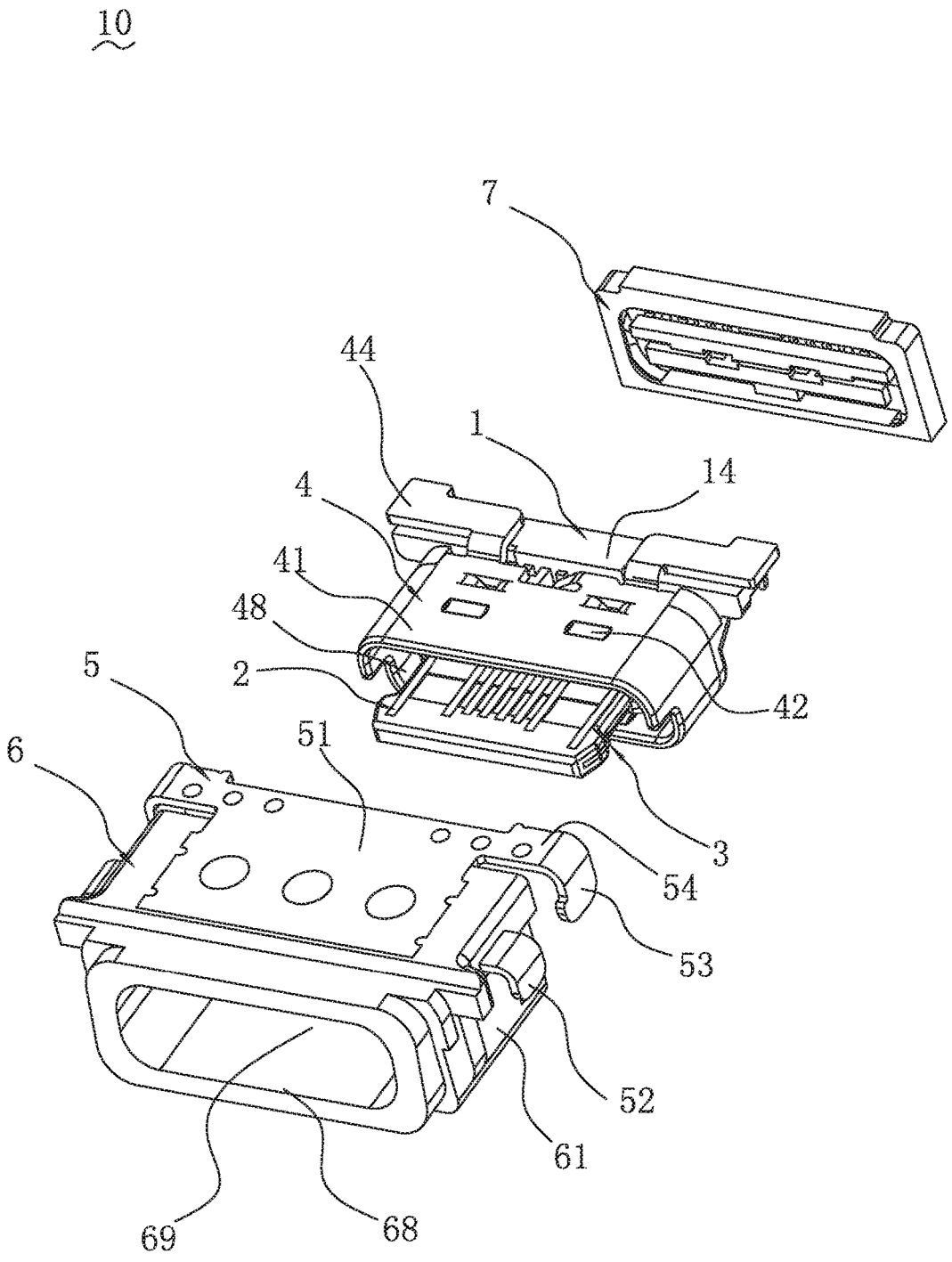
FIG. 5 is an exploded perspective view of the electrical connector of the preferred embodiment of the present disclosure.

While the present disclosure may be susceptible to embodiment in different forms, there is shown in the Figures, and will be described herein in detail, specific embodiments, with the understanding that the present disclosure is to be considered an exemplification of the principles of the present disclosure, and is not intended to limit the present disclosure to that as illustrated.

As such, references to a feature or aspect are intended to describe a feature or aspect of an example of the present disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the present disclosure, are not absolute, but relative. These representations are appropriate when the elements are in the position shown in the Figures. If the description of the position of the elements changes, however, these representations are to be changed accordingly.

An embodiment of the present disclosure will be described in detail in combination with the accompanying figures.

Referring to FIG. 1 to FIG. 7, the present disclosure takes a waterproof USB type-C connector as an example and provides an electrical connector 10 which can be correspondingly soldered to a circuit board 20 in a sinking manner. The electrical connector 10 comprises an insulating body 1, a plurality of conductive terminals 2 provided to the insulating body 1, a shielding plate 3 embedded in a middle part of the insulating body 1, a metal inner shell 4 sheathed and secured on the insulating body 1, a metal outer shell 5 encircling an outer periphery of the metal inner shell 4, an insulating outer shell 6 engaged with the metal outer shell 5 integrally and a seal 7 used to seal a rear end of the insulating outer shell 6.

The insulating body 1 is integrally formed by inject molding. The insulating body 1 comprises a housing 11 and a tongue 12 extending forwardly out from the housing 11. The housing 11 protrudes backwardly to provide a support portion 14 which extends transversely and its upper surface is a horizontal support surface.

The conductive terminals 2 are integrally formed by punching and bending a metal material. Each conductive terminal 2 comprises a mating portion 21 exposed on the tongue 12 and a soldering portion 22 extending backwardly out from the housing 11. The conductive terminals 2 are divided into two sets, that is an upper set and a lower set, the mating portions 21 of the two sets of conductive terminals 2 are arranged on an upper surface and a lower surface of the tongue 12 respectively, the soldering portions 22 of the two sets of conductive terminals 2 extend backwardly out from the support portion 14 and are arranged in-line behind the support portion 14.

The shielding plate 3 is integrally formed by punching and bending a metal material. The shielding plate 3 is positioned in the insulating body 1 for spacing the two sets of conductive terminals 2 apart from each other to provide the necessary electromagnetic isolation between the two sets of conductive terminals 2. The shielding plate 3 is provided with two soldering legs 32 extending backwardly out from the support portion 14. It can realize that the shielding plate 3 is grounded by soldering the soldering legs 32 to an electrically ground.

The metal inner shell 4 is integrally formed by punching and bending a metal sheet. The metal inner shell 4 surrounds to form a first frame 41 having a closed ring-shape, and two first wing plates 44 firstly extend backwardly and upwardly and then extend outwardly and transversely from a rear end of a top wall of the first frame 41. The first frame 41 is sheathed and fixed on the insulating body 1. The first frame 41 surrounds an outer periphery of a rear portion of the tongue 12 to form a fully enclosed mating cavity 48 (see FIG. 5). The two first wing plates 44 are correspondingly supported on the support portion 14 to prevent deformation of the two first wing plates 44.

Adopting the support portion 14 to support the first wing plates 44 is beneficial to ensure that the metal inner shell 4, especially the first wing plates 44 of the metal inner shell 4, will be securely engaged with the insulating body 1 so that the metal inner shell 4, especially the first wing plates 44, will not be easily deformed under an external force. In addition, a plurality of abutting convex portions 42 protrude from the first frame 41 into the inside of the mating cavity 48 for tightly abutting a metal outer shell (not shown) of another mating connector, which is beneficial to improve the grounding effect to prevent electromagnetic radiation from being leaked out.

The metal outer shell 5 is integrally formed by punching and bending a metal sheet. The metal outer shell 5 electrically connects with the metal inner shell 4 together. The metal outer shell 5 surrounds to form a second frame 51 having a ring-shape, and two second wing plates 54 transversely extends outwardly from both sides of a rear portion of a top wall of the second frame 51. Two sides of the second frame 51 are respectively torn and bent to respectively form two soldering legs 52. Outer sides of the two second wing plates 54 are also respectively bent outwardly to respectively form two soldering legs 53. The soldering legs 52, 53 can be correspondingly soldered on the circuit board 20 and electrically grounded.

The second frame 51 encircle an outer periphery of the first frame 41. The rear portion of the top wall of the second frame 51 and the two second wing plates 54 are correspondingly stacked above the two first wing plates 44. That the rear portion of the top wall of the second frame 51 and the two second wing plates 54 are correspondingly stacked above the two first wing plates 44 and are together supported by the support portion 14 is beneficial to ensure that the metal inner shell 4 and the metal outer shell 5 are securely engaged with the insulating body 1 so that the metal inner shell 4 and the metal outer shell 5 are not easily deformed under an external force.

In the embodiment, a front end of the top wall of the second frame 51 is generally flush with a front end of the top wall of the first frame 41 along a front-rear direction. A front end of a bottom wall of the second frame 51 extends forwardly beyond a front end of a bottom wall of the first frame 41. A rear end of the second wing plate 54 is flush with a rear end of the first wing plate 44. A rear end of the bottom wall of the first frame 41 extends backwardly beyond a rear end of the bottom wall of the second frame 51.

Figure 6:
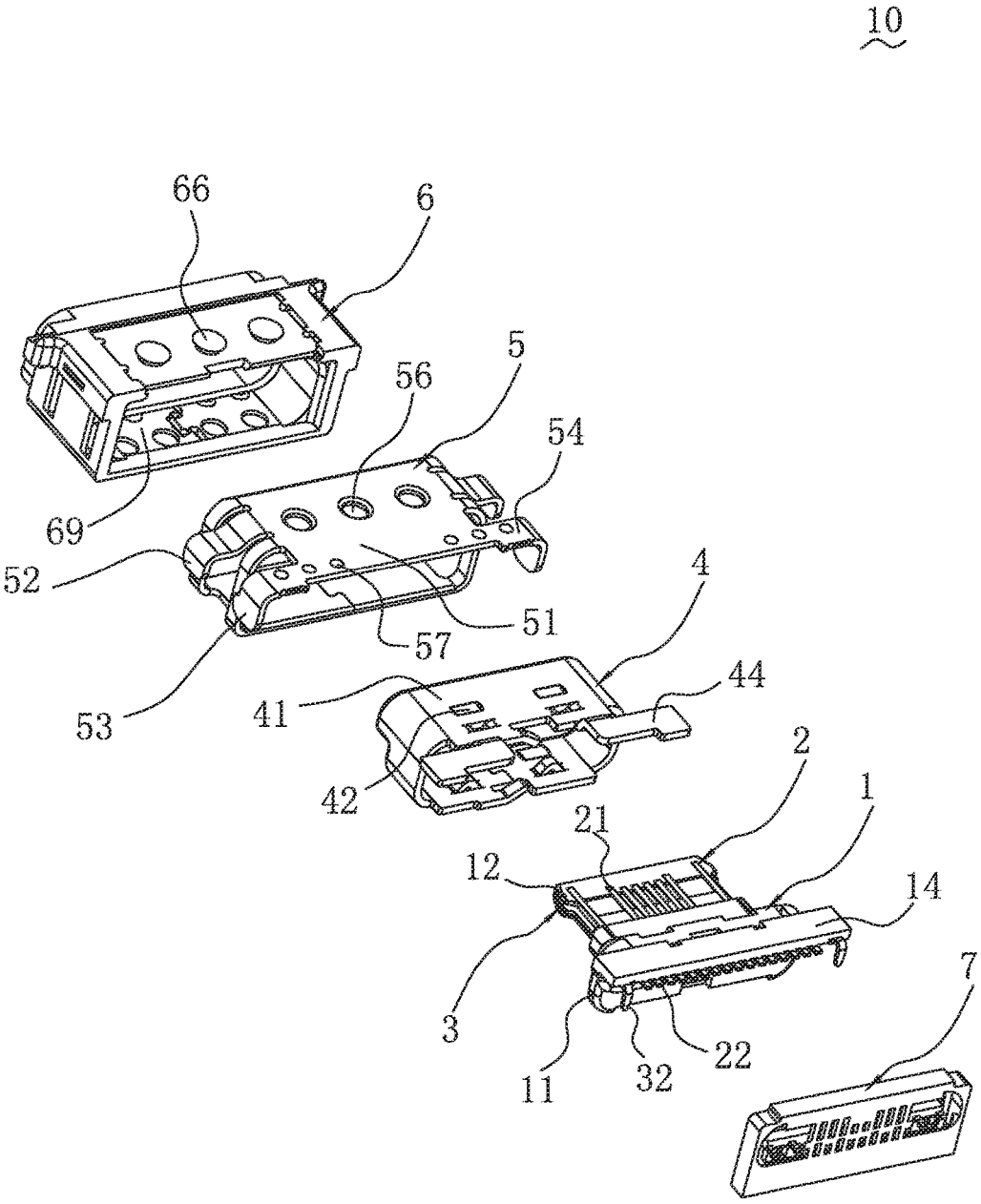
FIG. 6 and FIG. 7 are two further exploded perspective views, viewed from two different angles, of the electrical connector of the preferred embodiment of the present disclosure.
Figure 7:
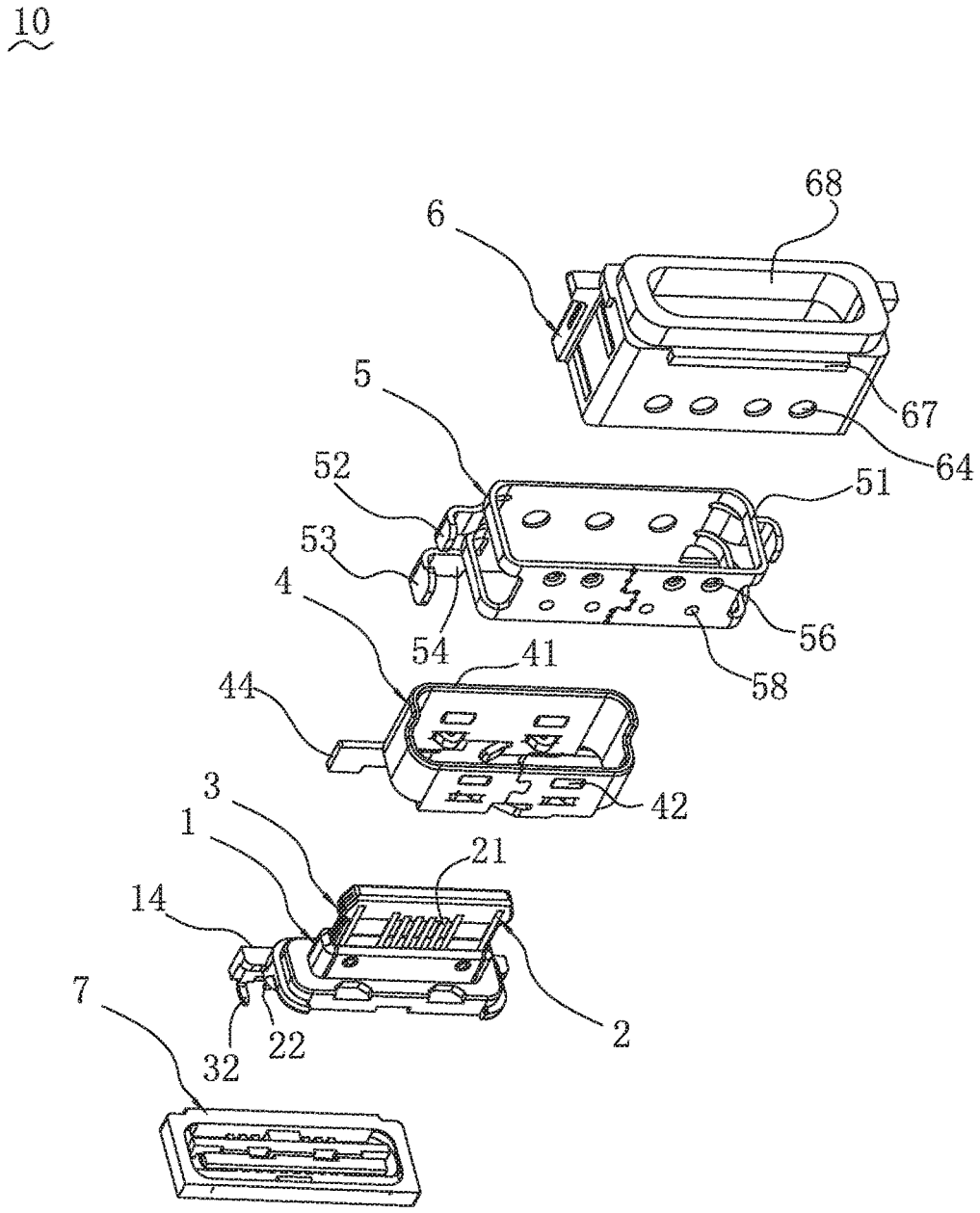

The first frame 41 and the second frame 51 are securely connected together by laser spot welding (see bottom wall welding spots 58 as shown in FIG. 7 and top wall welding spots 57 as shown in FIG. 6). The first wing plate 44 and the second wing plate 54 are preferably fixed by spot welding and achieve an electrical connection (see the top wall welding spots 57 as shown in FIG. 6). The second frame 51 is provided with a plurality of fixing holes 56 on the top and bottom walls for securely engaging with the insulating outer shell 6.

Such a structure of a double surrounding metal shell, which consists of the metal inner shell 4 and the metal outer shell 5, can reduce electromagnetic leakage and increase structural strength of the metal shell and effectively avoid the metal shell cracking. In addition, it can reduce the electromagnetic leakage and reduce the number of soldering legs of the double metal shell by the metal inner shell 41 surrounding to form the fully enclosed mating cavity 48 and arranging the soldering legs 52, 53 to the metal outer shell 5.

The insulating outer shell 6 is engaged with the metal outer shell 5 integrally by insert molding process. The insulating outer shell 6 comprises a main body 61. A rear portion of the insulating outer shell 6 is provided with a receiving cavity 69 for the metal inner shell 4 and the insulating body 1 inserted therein. A front portion of the insulating outer shell 6 surrounds an outer periphery of a front portion of the tongue 12 to form an insertion opening 68 which is communicated with the receiving cavity 69 along the front-rear direction, and an inner receiving space of the receiving cavity 69 is greater than an inner receiving space of the insertion opening 68. The insertion opening 68 is integrally communicated with the mating cavity 48 of the metal inner shell 4 along the front-rear direction, and an internal contour of the insertion opening 68 is preferably equal to or slightly less than an internal contour of the mating cavity 48 to allow another mating connector to pass through the insertion opening 68 and smoothly insert into the mating cavity 48.

The insulating outer shell 6 is correspondingly formed with a plurality of fixing columns 66 which protrude into the fixing holes 56 of the metal outer shell 5 respectively so as to enhance the engaging strength between the insulating outer shell 6 and the metal outer shell 5. A bottom wall of the insulating outer shell 6 is provided with a plurality of voiding holes 64 to facilitate welding the bottom wall welding spots 58 formed as in FIG. 7. Such a structure of the insertion opening 68 formed by plastic injection molding has a good dimensional precision relative to the existing metal inner shell 4 formed by punching and bending, which facilitates the smooth insertion of the mating connector and prevents the metal inner shell 4 from cracking.

In the embodiment, a front end face 65 of the insulating outer shell 6 is an oblique face, and a front end of the bottom wall of the insulating outer shell 6 extends forwardly beyond a front end of a top wall of the insulating outer shell 6. An outer periphery of the front portion of the insulating outer shell 6 is also preferably sheathed with a waterproof sealing ring (not shown). The outer periphery of the front portion of the insulating outer shell 6 is also formed with a stop portion 67 which cooperates with the waterproof sealing ring. Such a structure is beneficial for the electrical connector 10 to tightly fit with a casing of an electronic device such as smart phones so as to prevent water from entering into the electronic device via an opening on the casing.

The seal 7 is formed by curing a waterproof sealing glue applied to a rear portion of the housing 11 for sealing a rear end of the receiving cavity 69 of the insulating housing 6 so that outside water can be prevented from entering into an electronic device (such as a cell phone) via the front of the electrical connector 10. The support portion 14 protrudes backwardly relative to the seal 7. Since the soldering portions 22 of the conductive terminals 2 and the soldering legs 32 of the shielding plate 3 extend backwardly out from the supporting portion 14, it can prevent the soldering portions 22 and the soldering legs 32 from unnecessarily adhering to the waterproof sealing glue forming the seal 7, which will result in deterioration of electrical properties.

A manufacturing process of the electrical connector 10 of the present disclosure generally comprises: engaging the insulating body 1 with the conductive terminals 2 and the shielding plate 3 integrally by the insert molding process; sheathing and fixing the metal inner shell 4 on the outer periphery of the insulating body 1; forming the insulating outer shell 6 on the basis of the metal outer shell 5 by the inject molding and engaging the insulating outer shell 6 and the metal outer shell 5 integrally by the insert molding process; then inserting a combination of the metal inner shell 4 and the insulating body 1 into the receiving cavity 69 from the rear to the front; then securely connecting the metal outer shell 5 with the metal inner shell 4 together by laser spot welding; finally, forming the seal 7 on the rear end of the receiving cavity 69 of the insulating outer shell 6 by a glue dispensing process.

Compared with the prior art, by that the second frame 51 of the metal outer shell 5 sheathes on and electrically connects with the first frame 41 of the metal inner shell 4 together, the complete mating cavity 48 is surrounded and formed by the first frame 41, and the electrical connector 10 is electrically grounded via the soldering legs 52, 53 of the metal outer shell 5, the present disclosure can reduce electromagnetic leakage and increase the overall structure strength of the electrical connector 10; in addition, by engaging the insulating outer shell 6 with the metal outer shell 5 integrally by the insert molding process, and forming the insertion opening 68 communicated with the mating cavity 48 along the front-rear direction at the front portion of the insulating outer shell 6, and the internal contour of the insertion opening 68 is preferably equal to or slightly less than the internal contour of the mating cavity 48, it facilitates the smooth insertion of another mating connector.

The above disclosure only relates to the embodiments of the present disclosure, but does not limit implementing solutions of the present disclosure. According to main conception and spirit of the present disclosure, a person skilled in the art may conveniently make various variations or modifications. Therefore, the protection scope of the present disclosure is determined by the scope of the appended claims.

What is claimed is:

1. An electrical connector, which is used to correspondingly mate with another mating connector, comprising:

an insulating body which comprises a housing and a tongue extending forwardly out from the housing;

a plurality of conductive terminals, each conductive terminal having a mating portion exposed on the tongue and a soldering portion extending backwardly out from the housing;

wherein the electrical connector further comprising:

a metal inner shell which surrounds to form a first frame, the first frame being fixed on the insulating body and surrounding a rear portion of the tongue to form a mating cavity;

a metal outer shell which surrounds to form a second frame, the second frame encircling an outside of the first frame, the metal outer shell being electrically connected with the metal inner shell together, a plurality of soldering legs extending out from two sides of the metal outer shell; and an insulating outer shell which is engaged with the metal outer shell integrally, a rear portion of the insulating outer shell being formed with a receiving cavity;

wherein the metal inner shell being correspondingly inserted in the receiving cavity, the insulating outer shell surrounding a front portion of the tongue and forming an insertion opening, the insertion opening being integrally communicated with the mating cavity along a front-rear direction.

2. The electrical connector according to claim 1, wherein the metal inner shell further comprises two first wing plates extending out from a rear end of the first frame;

the metal outer shell further comprises two second wing plates respectively extending out from the second frame, the two second wing plates correspondingly stack above the two first wing plates and are correspondingly electrically connected.

3. The electrical connector according to claim 2, wherein the housing of the insulating body protrudes backwardly to provide a support portion, the two first wing plates are correspondingly supported on the support portion.

4. The electrical connector according to claim 3, wherein the soldering portions of the conductive terminals extend backwardly out from the support portion;

the electrical connector further comprises a seal formed by a sealing glue applied on a rear portion of the receiving cavity of the insulating outer shell, the support portion passes backwardly through the seal.

5. The electrical connector according to claim 2, wherein two sides of the second frame are respectively torn and bent to respectively form two soldering legs, two outer sides of the two second wing plates are also respectively bent to form two soldering legs.

6. The electrical connector according to claim 2, wherein the first wing plate and the second wing plate are securely connected together by laser spot welding.

7. The electrical connector according to claim 1, wherein a plurality of abutting convex portion protrude from the first frame toward the inside of the mating cavity, and are used to engage with the another mating connector.

8. The electrical connector according to claim 1, wherein an internal contour of the insertion opening is equal to or slightly smaller than an internal contour of the mating cavity, and the another mating connector passes through the insertion opening and inserts into the mating cavity.

9. The electrical connector according to claim 1, wherein the insulating outer shell is engaged with the metal outer shell integrally by insert molding process; and wherein the second frame is penetratingly provided with a plurality of fixing holes, the insulating outer shell are correspondingly formed with a plurality of fixing columns which protrude into the fixing holes respectively.

10. The electrical connector according to claim 1, wherein an outer periphery of a front portion of the insulating outer shell is sheathed with a waterproof sealing ring.

* * * * *